US009570258B2

(12) United States Patent
Park

(10) Patent No.: US 9,570,258 B2
(45) Date of Patent: Feb. 14, 2017

(54) MAGNETIC SWITCH

(71) Applicant: LSIS CO., LTD., Anyang-si, Gyeonggi-do (KR)

(72) Inventor: Jinhee Park, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/981,552

(22) Filed: Dec. 28, 2015

(65) Prior Publication Data

US 2016/0300677 A1 Oct. 13, 2016

(30) Foreign Application Priority Data

Apr. 13, 2015 (KR) ..... 10-2015-0051883

(51) Int. Cl.

| | |
|---|---|
| ***H01H 67/02*** | (2006.01) |
| ***H01H 50/16*** | (2006.01) |
| ***H01H 50/44*** | (2006.01) |
| ***H01H 9/44*** | (2006.01) |
| ***H01H 50/04*** | (2006.01) |
| *H01H 1/20* | (2006.01) |

(52) U.S. Cl.

CPC ..... *H01H 50/16* (2013.01); *H01H 9/443* (2013.01); *H01H 50/041* (2013.01); *H01H 50/44* (2013.01); *H01H 1/20* (2013.01); *H01H 2050/046* (2013.01); *H01H 2205/002* (2013.01)

(58) Field of Classification Search

CPC ..... H01H 50/16; H01H 50/20; H01H 51/01; H01H 51/22; H01H 51/2209

USPC ..... 335/137

See application file for complete search history.

(56) References Cited

U.S. PATENT DOCUMENTS

| | | | | |
|---|---|---|---|---|
| 3,594,526 | A | 7/1971 | Swindler | |
| 4,004,260 | A | 1/1977 | Happach | |
| 5,563,563 | A * | 10/1996 | Freitas | H01H 1/04 335/126 |
| 5,892,194 | A * | 4/1999 | Uotome | H01H 1/34 218/68 |
| 6,700,466 | B1 * | 3/2004 | Yamamoto | H01H 9/302 218/156 |
| 7,157,995 | B2 * | 1/2007 | Nishida | H01H 50/36 335/126 |
| 7,477,119 | B2 * | 1/2009 | Wu | H01H 50/043 335/128 |
| 7,551,049 | B2 * | 6/2009 | Hirabayashi | H01H 51/065 335/106 |
| 7,852,178 | B2 * | 12/2010 | Bush | H01H 51/2209 335/126 |

(Continued)

FOREIGN PATENT DOCUMENTS

| | | |
|---|---|---|
| DE | 202011108849 | 1/2012 |
| JP | 60-107551 | 7/1985 |

OTHER PUBLICATIONS

European Patent Office Application No. 16151518.4, Search Report dated Aug. 30, 2016, 8 pages.

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

The present invention relates to a magnetic switch, and more particularly, to a magnetic switch provided with a permanent magnet disposed at an outside of an upper frame and an externally fitted permanent magnet holder to reduce a number of components and facilitate maintenance.

8 Claims, 8 Drawing Sheets

(56) References Cited

U.S. PATENT DOCUMENTS 7,911,301 B2 * 3/2011 Yano ..... H01H 9/443 335/131
8,138,863 B2 * 3/2012 Tanaka ..... H01H 1/54 335/126
8,198,964 B2 * 6/2012 Yoshihara ..... H01H 51/29 335/131
8,274,345 B2 * 9/2012 Sugisawa ..... H01H 50/54 335/126
8,310,323 B2 * 11/2012 Niimi ..... H01H 50/023 335/131
8,395,463 B2 * 3/2013 Ito ..... H01H 9/34 335/202
8,492,916 B2 * 7/2013 Murata ..... F02N 11/087 290/38 R
8,642,906 B2 * 2/2014 Yeon ..... H01H 50/023 200/430
2004/0027776 A1 * 2/2004 Uotome ..... H01H 47/06 361/160
2004/0080389 A1 * 4/2004 Nishida ..... H01H 50/026 335/132
2005/0030136 A1 * 2/2005 Babich ..... H01F 3/02 335/220
2005/0156469 A1 * 7/2005 Nishida ..... H01H 9/443 310/40 MM
2006/0050466 A1 * 3/2006 Enomoto ..... H01H 50/02 361/160
2006/0180576 A1 8/2006 Rab et al.
2007/0241847 A1 * 10/2007 Yamamoto ..... H01H 50/305 335/196
2009/0066450 A1 * 3/2009 Yano ..... H01H 49/00 335/203
2009/0127229 A1 5/2009 Schmitz et al.
2009/0243771 A1 * 10/2009 Uruma ..... H01H 50/04 335/193
2009/0322453 A1 * 12/2009 Kawaguchi ..... H01F 7/1615 335/81
2009/0322455 A1 * 12/2009 Yoshihara ..... H01F 7/1615 335/189
2011/0120844 A1 * 5/2011 Hoffmann ..... H01H 50/02 200/275
2013/0012037 A1 * 1/2013 Enomoto ..... H01H 9/443 439/39
2013/0057369 A1 * 3/2013 Yano ..... H01H 1/66 335/156
2013/0127571 A1 * 5/2013 Takaya ..... H01H 9/443 335/201
2013/0169389 A1 * 7/2013 An ..... H01H 50/163 335/207
2013/0335175 A1 * 12/2013 Tachikawa ..... H01H 1/54 335/147
2014/0022035 A1 1/2014 Yamashita et al.
2015/0255236 A1 * 9/2015 Enomoto ..... H01H 1/54 335/187

* cited by examiner

MAGNETIC SWITCH

CROSS-REFERENCE TO RELATED APPLICATIONS

Pursuant to 35 U.S.C. §119(a), this application claims the benefit of earlier filing date and right of priority to Korean Patent Application No. 10-2015-0051883, filed on Apr. 13, 2015, the contents of which are hereby incorporated by reference herein in its entirety.

BACKGROUND OF THE INVENTION

1. Field of the Invention

The present invention relates to a magnetic switch, and more particularly, to a magnetic switch provided with a permanent magnet disposed at an outside of an upper frame and an externally fitted permanent magnet holder to reduce a number of components and facilitate maintenance.

2. Description of the Related Art

In general, as a type of electrical circuit switching device for transferring mechanical drives and current signals using the principle of an electromagnet, a magnetic switch or direct current relay is installed in various facilities, machines, vehicles and the like.

In particular, in case of a relay for electric vehicles, it may be located at a battery system in an electric vehicle such as a hybrid vehicle, a fuel cell vehicle, a golf cart and an electric forklift to perform the role of switching the conductivity of a main current.

A direct current relay for electric vehicles may include a high voltage portion and a low voltage portion. The high voltage (HV) portion is connected to an electric wire or bus bar to take charge of the conduction and blocking of a main current, and the low voltage (LV) portion operates a drive unit to turn on or off the direct current relay. In general, a direct current relay for electric vehicles is located within a battery system.

FIG. 1 illustrates a lateral longitudinal cross-sectional view of a magnetic switch according to the related art, and FIG. 2 illustrates an internal perspective view of an upper frame assembly in FIG. 1.

The configuration of a direct current relay for electric vehicles may include a lower frame 1, an upper frame 2, a pair of fixed contacts 3 and movable contacts 4 installed within the upper frame 2, and an electric actuator 5 installed within the lower frame 1 to drive the movable contacts 4 to allow the switching control of contacts due to an electrical signal. A permanent magnet 6*a*, 6*b* is fixed to a permanent magnet holder 7 and provided within the upper frame 2 to effectively control an arc occurring during the blocking of contacts.

The operation during the blocking will be described with reference to FIG. 3. A pair of fixed contacts 3 (3*a*, 3*b*) are configured with two main contact terminals to have a positive (+) and a negative (−) polarity. A permanent magnet 6*a*, 6B installed within the upper frame 2 forms a magnetic field (B), and fixed to a permanent magnet holder (not shown) to provide the path of a magnetic field. A magnetic field (B) generated from the permanent magnet 6*a*, 6*b* interacts with a current (+I, −I) to generate a force (+F, −F) of pushing an arc occurring during the switching to an outside, thereby performing the role of reducing the damage of a contact portion.

However, a magnetic switch according to the related art is assembled in such a manner that two permanent magnet holders 7 are pushed and installed into the upper frame 2 in a symmetric manner, and then permanent magnets 6*a*, 6*b* are coupled to both end portions of two permanent magnet holders 7, respectively. The reason of providing two permanent magnet holders 7 is that the operation of pushing and installing into the upper frame 2 is difficult with one integrated form of permanent magnet holder 7. In other words, there is a drawback of increasing the number of components and deteriorating the work process.

Furthermore, two permanent magnet holders 7 are pushed and installed into the upper frame 2, which is a plastic injection molded part, thereby causing a problem of suppressing the intrinsic function of permanent magnets 6*a*, 6*b* in case where the permanent magnet holders 7 are released therefrom.

Moreover, it is assembled such a manner that the permanent magnets 6*a*, 6*b* are fixed to the permanent magnet holders 7 and the permanent magnet holders 7 are pushed and installed into the upper frame 2, thereby deteriorating the disassembly performance and causing a damage on the surrounding parts during the process of performing dismantling operation when the permanent magnets 6*a*, 6*b* are removed for maintenance or the like.

SUMMARY OF THE INVENTION

The present invention is contrived to solve the foregoing problems, and an aspect of the present invention is to provide a magnetic switch provided with a permanent magnet disposed at an outside of an upper frame and an externally fitted permanent magnet holder so as to reduce a number of components and facilitate maintenance.

A magnetic switch according to an embodiment of the present disclosure may include an upper frame formed in a box shape on which a lower surface thereof is open; a pair of fixed contacts installed in a fixed manner within the upper frame; a movable contact brought into contact with or separated from the pair of fixed contacts to conduct or block a circuit; a pair of permanent magnets disposed on part of the upper frame; and a permanent magnet holder coupled to part of the upper frame to fix the pair of permanent magnets to the upper frame, wherein a first and a second mounting portion are provided at outer sides on a front and a rear surface of the upper frame, respectively, to place the pair of permanent magnets into the first and the second mounting portion, and the permanent magnet holder is formed in a U-shape and coupled to an upper portion of the upper frame to fix the pair of permanent magnets to an outside of the upper frame.

Here, the first and the second mounting portion may have a groove formed with a width and area capable of accommodating the permanent magnet.

Furthermore, a holder insertion portion into which the permanent magnet holder can be fixed may be formed on an upper surface of the upper frame.

Furthermore, the holder insertion portion may include a groove portion formed between a pair of protrusion portions protruded in an "11" shape.

Furthermore, part of the holder insertion portion may be protruded from a front surface of the upper frame to form a support portion.

Furthermore, the permanent magnet holder may include a body portion formed to transverse an upper surface of the upper frame and bridge portions extended in a vertically downward direction at both end portions of the body portion.

Furthermore, engagement portions engaged with lower end portions of the first and the second mounting portion, respectively, may be formed in a bent manner at both end portions of the permanent magnet holder.

Furthermore, adhesion portions capable of applying a contact pressure to the permanent magnets, respectively, may be formed at both end portions of the permanent magnet holder.

In addition, a handle portion may be provided on part of the permanent magnet holder.

According to a magnetic switch according to an embodiment of the present disclosure, a permanent magnet may be coupled to an outside of the upper frame by a permanent magnet holder, thereby having an effect of facilitating the assembly and removal work. Furthermore, it may reduce possibility of damaging the surrounding components during the removal.

On the other hand, the permanent magnet holder may be configured with a single component, thereby implementing the simplification of components and reducing the manufacturing cost.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a preferred embodiment of the present invention will be described in detail with reference to the accompanying drawings to such an extent that the present invention can be easily implemented by a person having ordinary skill in the art to which the present invention pertains, but it does not mean that the technical concept and scope of the present invention are limited due to this.

Figure 1:
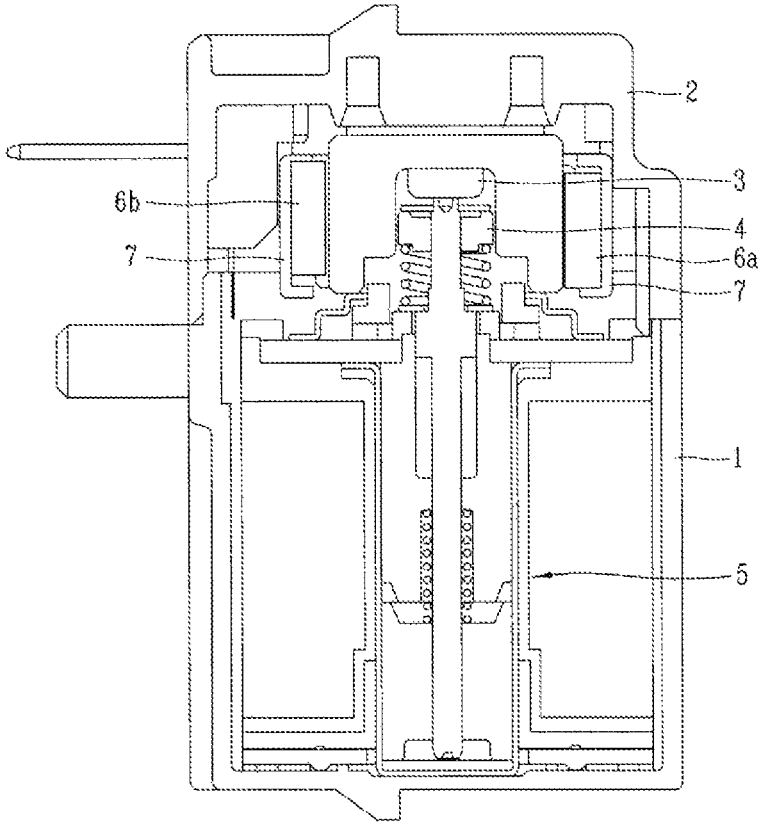
Fig. 1 Prior Art
FIG. 1 is a lateral longitudinal cross-sectional view illustrating a magnetic switch according to the related art.
Figure 2:
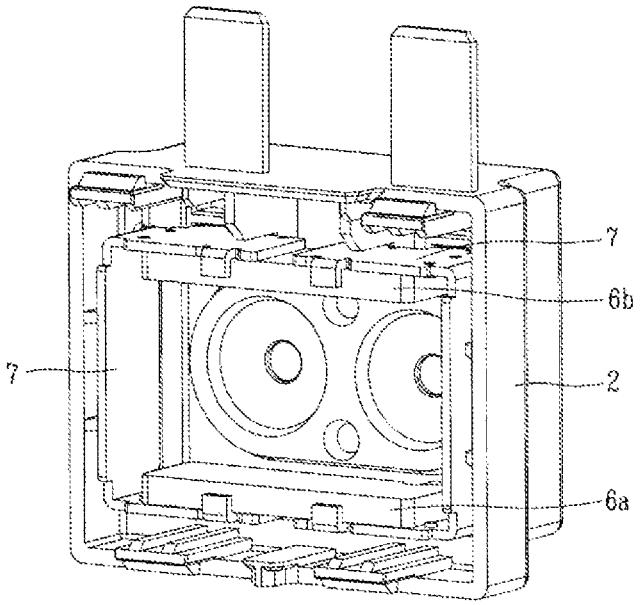
Fig. 2 Prior Art
FIG. 2 is an internal perspective view illustrating an upper frame assembly in FIG. 1.
Figure 3:
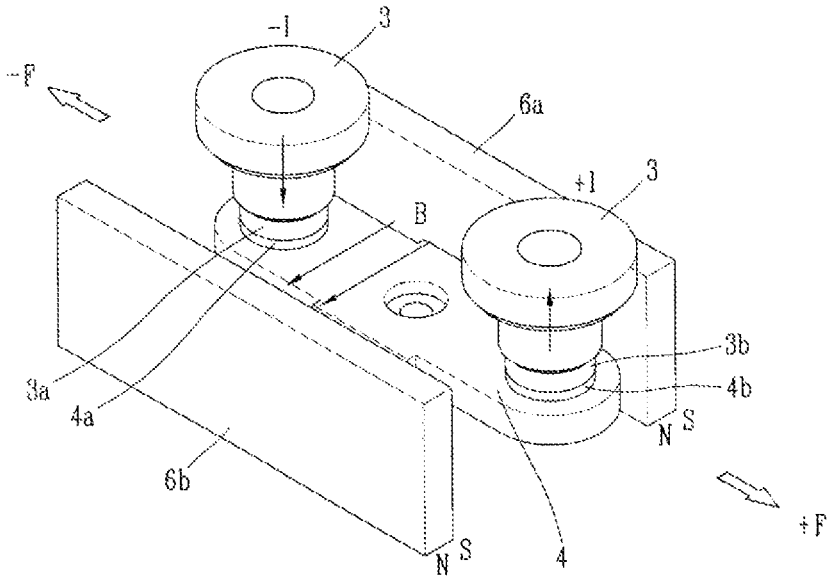
Fig. 3 Prior Art
FIG. 3 is a configuration diagram illustrating an interactive relationship between a contact portion and a permanent magnet during the blocking in a magnetic switch according to the related art.
Figure 4:
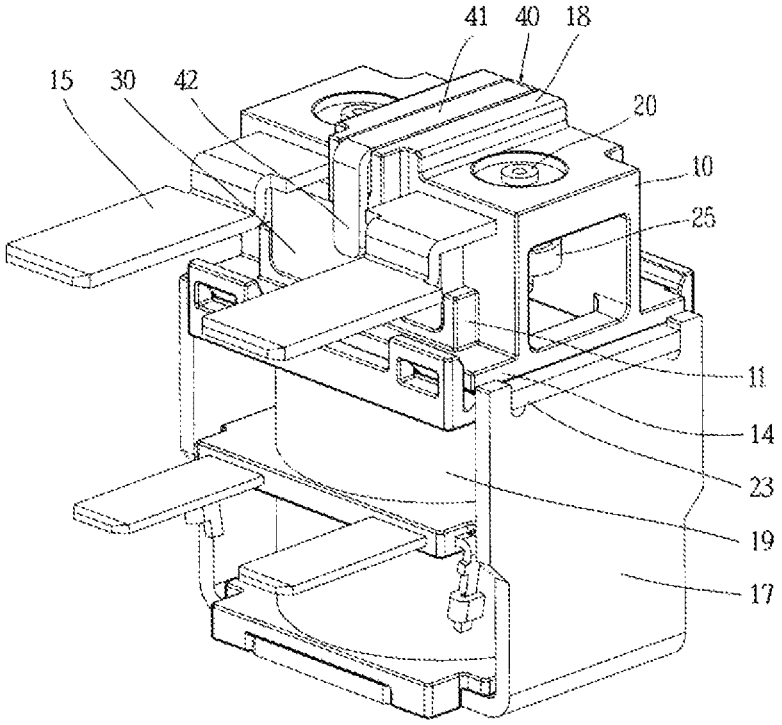
FIG. 4 is a perspective view illustrating a magnetic switch according to an embodiment of the present disclosure, in a state that a case is removed therefrom.
Figure 5:
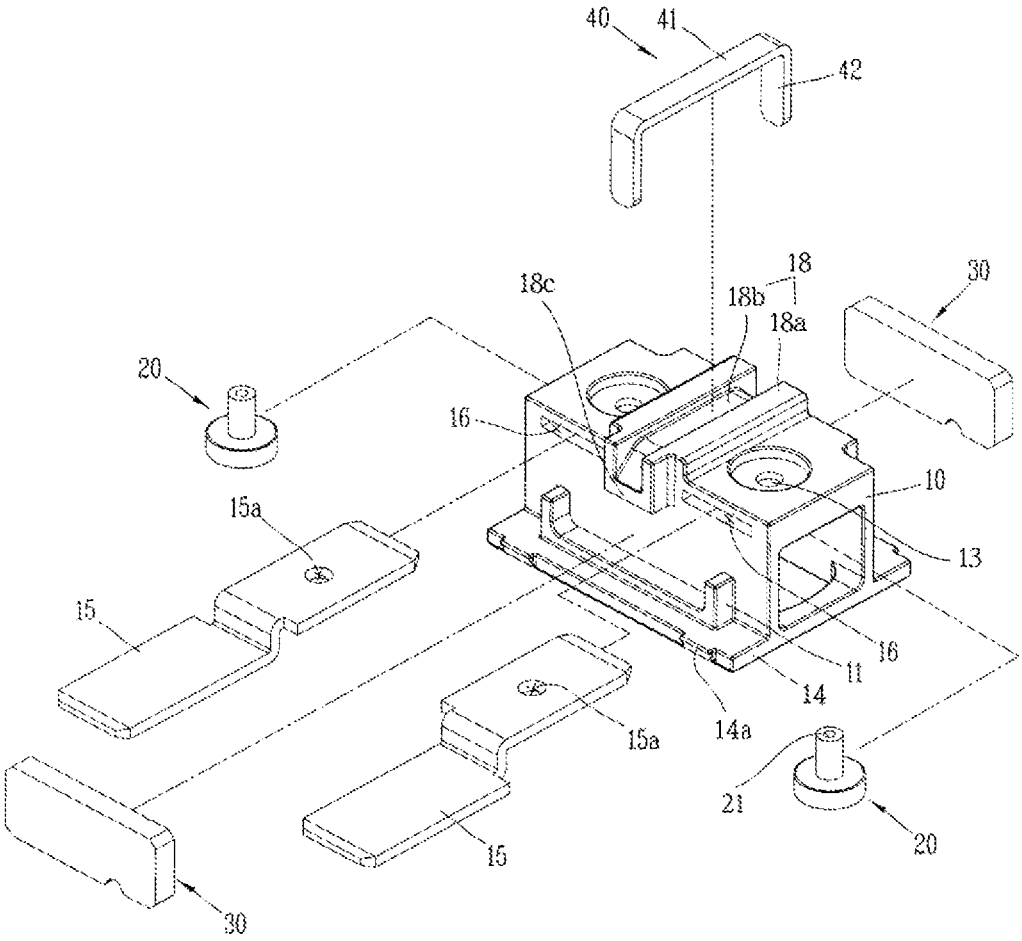
FIG. 5 is an exploded perspective view illustrating an upper frame assembly in FIG. 4.
Figure 6:
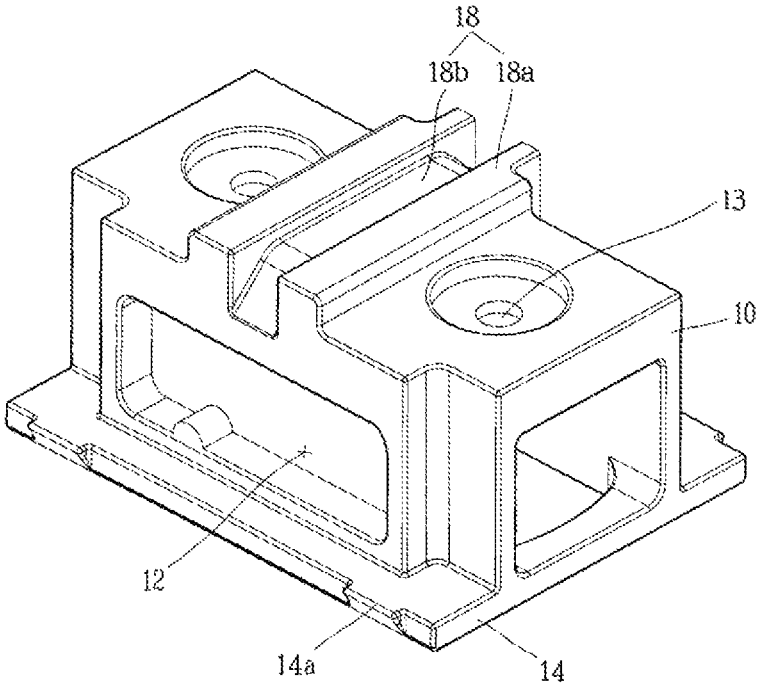
FIG. 6 is a rear perspective view illustrating an upper frame in FIG. 4.

FIG. 4 illustrates a perspective view of a magnetic switch according to an embodiment of the present disclosure, and FIG. 5 illustrates an exploded perspective view of an upper frame assembly, and FIG. 6 illustrates a rear perspective view of an upper frame. A magnetic switch according to each embodiment of the present disclosure will be described in detail with reference to the accompanying drawings.

A magnetic switch according to an embodiment of the present disclosure may include an upper frame 10 formed in a box shape on which a lower surface thereof is open; a pair of fixed contacts 20 installed in a fixed manner within the upper frame 10; a movable contact 25 brought into contact with or separated from the pair of fixed contacts 20 to conduct or block a circuit; a pair of permanent magnets 30 disposed on part of the upper frame 10; and a permanent magnet holder 40 coupled to part of the upper frame 10 to fix the pair of permanent magnets 30 to the upper frame 10, wherein a first and a second mounting portion 11, 12 are provided at outer sides on a front and a rear surface of the upper frame 10, respectively, to place the pair of permanent magnets 30 into the first and the second mounting portion 11, 12, and the permanent magnet holder 40 is formed in a U-shape and coupled to an upper portion of the upper frame 10 to fix the pair of permanent magnets 30 to an outside of the upper frame 10.

The upper frame 10 may be formed in a box shape on which a lower surface thereof is open. The upper frame 10 may be formed of a synthetic resin material such as plastic. The upper frame 10 may be formed of an injection molded part.

A support surface 14 extended to a front and a rear side may be formed at a lower portion of the upper frame 10. A plurality of fixed protrusions 14*a* capable of fixing the upper frame 10 to a plate 23 for connecting the upper frame 10 to a lower frame 17 may be formed in a protruding manner on the support surface 14.

A pair of contact holes 13 on which the fixed contacts 20 can be installed are formed on an upper surface of the upper frame 10.

A pair of insertion grooves 16 into which a terminal 15 or bus bar connected to the fixed contact 20 can be inserted are formed on a front surface of the upper frame 10. The positions of the insertion grooves may correspond to the positions of the fixed contacts 20, respectively. Here, the terminal 15 may be formed of a material such as silver (Ag) or the like having a good conductivity. Furthermore, a through hole 15*a* into which the fixed contact 20 can be inserted and installed is formed on part of the terminal 15.

A first mounting portion 11 on which a permanent magnet 30 can be mounted is formed on a front surface of the upper frame 10. The first mounting portion 11 may be formed in a protruding manner in a substantially U shape at a lower portion of the upper frame 10 in consideration of a place at which the insertion grooves 16 is formed. The first mounting portion 11 has a width and area capable of accommodating the permanent magnet 30.

A second mounting portion 12 on which a permanent magnet 30 can be mounted is formed on a rear surface of the upper frame 10. The second mounting portion 12 may be formed in a protruding manner in a substantially "□" shape. An inner portion of the second mounting portion 12 has a width and area capable of accommodating the permanent magnet 30.

A holder insertion portion 18 into which a permanent magnet holder 40 can be inserted and fixed may be formed at a central portion on an upper surface of the upper frame 10. The holder insertion portion 18 may be configured with a groove portion 18*b* between a pair of protrusion portions 18*a* protruded in an "11" shape. Part of the holder insertion portion 18 may be protruded to a front surface of the upper frame 10 to form a support portion 18*c*. The support portion 18*c* along with the first mounting portion 11 supports the permanent magnet 30.

The lower frame 17 is coupled to a lower portion of the plate 23, and a coil assembly 19 and an actuator (not shown) may be installed therewithin.

A pair of fixed contacts 20 are terminals that can be inserted into the through holes 15*a* of the terminals 15 and the contact holes 13 of the upper frame 10 to be exposed to an outside of the upper frame 10, and connected to a power source or load. A pair of fixed contacts 20 may be formed of a material such as copper (Cu) or the like having a good conductivity. An upper end portion of the pair of fixed contacts 20 may be connected to a power source or load, and a lower end portion thereof may be brought into contact with the moving contact 25. A connecting groove 21 may be formed on an upper end portion of the pair of fixed contacts 20 to insert a contact terminal of load thereinto.

The fixed contacts 20 are inserted into the through holes 15*a* of the terminals 15 and the contact holes 13 of the upper frame 10 from the bottom to the top direction in a state that the terminals 15 are inserted into the insertion grooves 16 of the upper frame 10, and coupled thereto in a manner of being pressed and riveted at an upper portion in a state of being fixed and supported by a jig or the like.

The movable contact 25 is a terminal inserted into the upper frame 10 and brought into contact with and separated from a pair of fixed contacts 20. The movable contact 25 is brought into contact with a lower end portion of the foregoing pair of fixed contacts 20. The movable contact 25 is a plate-shaped body having a predetermined thickness on which a surface facing the fixed contact 20 is formed in a flat shape. The movable contact 25 may be fixed to a drive shaft (not shown) installed within the coil assembly 19, and brought into contact with or separated from a pair of fixed contacts 20 as the drive shaft is linearly driven along an axial direction. A circuit is closed to allow conduction when the movable contact 25 is brought into contact with a pair of fixed contacts 20, and the circuit is open to block the flow of a current when the movable contact 25 is separated from a pair of fixed contacts 20.

A pair of permanent magnets 30 are installed on the upper frame 10. The pair of permanent magnets 30 may be installed on the first mounting portion 11 and second mounting portion 12, respectively. Here, the position of the permanent magnet 30 corresponds to a position at which the fixed contact 20 is brought into contact with the movable contact 25 based on the height. At this time, the pair of permanent magnets 30 may be installed such that surfaces having the same polarity direct the same direction. For example, they may be installed such that the S-pole (N-pole) is directed to the front. In this manner, a magnetic field directed from the rear to the front (or directed from the front to the rear) may be formed within the upper frame 10. In general, they are installed such that an arc generated during the blocking due to an interaction between the magnetic field and a current flowing through a pair of fixed contacts 20 in an upward or downward direction, respectively, receives a force of being pushed to an outer side.

The permanent magnet holder 40 may be formed in a substantially U-shape. The permanent magnet holder 40 may be made of a steel.

The permanent magnet holder 40 may include a body portion 41 formed to transverse an upper surface of the upper frame 10 and bridge portions 42 extended in a vertically downward direction at both end portions of the body portion 41.

A distance between both the bridge portions 42 may be set to a distance that can be engaged in a fitting manner to provide a contact pressure capable of fixing a pair of permanent magnets 30 thereto in a state that that the permanent magnets 30 are coupled to the first mounting portion 11 and second mounting portion 12, respectively.

The body portion 41 may be inserted and fixed into the holder insertion portion 18 of the upper frame 10. The body portion 41 is fixed to the holder insertion portion 18 in a state that a pair of permanent magnets 30 are placed on the first and the second mounting portion 11, 12, respectively, and both the bridge portions 42 support the pair of permanent magnets 30, and thus the pair of permanent magnets 30 are stably coupled to the upper frame 10.

A pair of permanent magnets 30 may be placed on an outside of the upper frame 10, and the permanent magnet holder 40 may be coupled thereto with a simple fitting operation without the help of a jig or the like, thereby having an effect of simplifying the work process and reducing the manufacturing time compared to the related art in which they are installed within the upper frame. Furthermore, a complicated disassembly work due to tools is not required as in the related art since the disassembly work is completed by simply separating the permanent magnet holder 40 therefrom even during the disassembly work for maintenance, thereby having an effect of simplifying the work process and reducing the manufacturing time. Furthermore, according to the related art, there is a possibility of deteriorating the disassembly work of permanent magnets and damaging the surrounding components during the process of using a tool or the like, but a magnetic switch according to an embodiment of the present disclosure has an effect of significantly reducing the possibility of damage.

Figure 7:
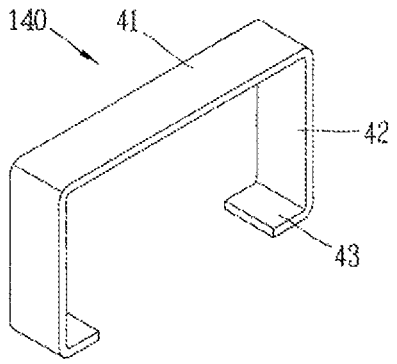
FIG. 7 is a perspective view illustrating a permanent magnet holder according to another embodiment of the present disclosure.

FIG. 7 illustrates a perspective view of a permanent magnet holder according to another embodiment of the present disclosure. According to the present embodiment, the permanent magnet holder 140 is formed such that an engagement portion 43 is bent in an inward direction at a lower end of the bridge portion 42. The permanent magnet 30 is more stably fixed by the engagement portion 43 engaged with a lower portion of the first and the second mounting portion 12 to prevent the permanent magnet 30 from being released during use.

Figure 8:
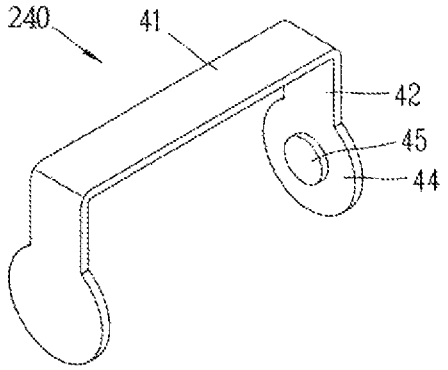
FIGS. 8, 9 and 10 are perspective views illustrating a permanent magnet holder according to still another embodiment of the present disclosure, respectively.

FIG. 8 illustrates a perspective view of a permanent magnet holder according to still another embodiment of the present disclosure. According to the present embodiment, an adhesion portion 44 is formed at a lower end of the bridge portion 42 of the permanent magnet holder 240. The width of the adhesion portion 44 is formed to be larger than that of the bridge portion 42 to increase a contact area to the permanent magnet 30. Accordingly, it has an effect of increasing a force supporting the permanent magnet 30. According to the embodiment, a contact pressure portion 45 formed in a protruding manner may be provided at an inner side of the adhesion portion 44 to further increase a contact pressure force to the permanent magnet 30.

Figure 9:
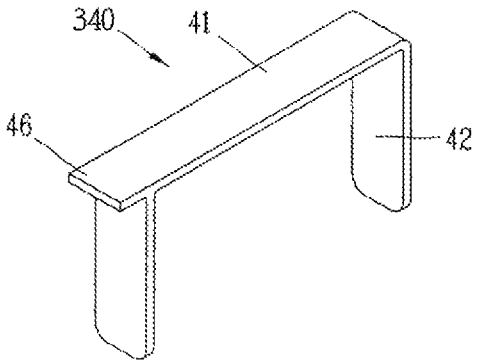
Figure 10:
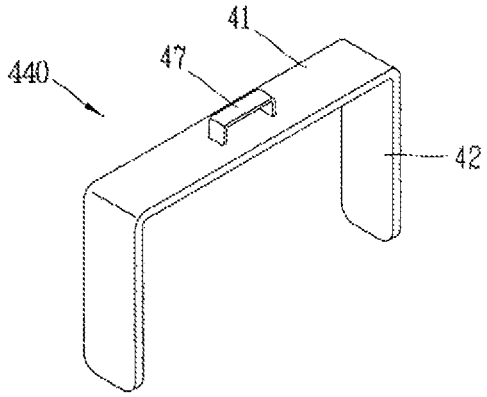

FIGS. 9 and 10 illustrate perspective views of a permanent magnet holder according to still yet another embodiment of the present disclosure. According to the present embodiment, a permanent magnet holder 340, 440 may include a handle portion 46, 47 formed on part of the body portion 41. The handle portion 46, 47 allows an effect of more easily performing a release operation when releasing the permanent magnet holder 340, 440.

According to a magnetic switch according to an embodiment of the present disclosure, a permanent magnet may be coupled to an outside of the upper frame by a permanent magnet holder, thereby having an effect of facilitating the assembly and removal work. Furthermore, it may reduce possibility of damaging the surrounding components during the removal.

On the other hand, the permanent magnet holder may be configured with a single component, thereby implementing the simplification of components and reducing the manufacturing cost.

It will be apparent to those skilled in this art that various changes and modifications may be made thereto without departing from the gist of the present invention. Accordingly, it should be noted that the embodiments disclosed in the present invention are only illustrative and not limitative to the concept of the present invention, and the scope of the concept of the invention is not limited by those embodiments. The scope protected by the present invention should be construed by the accompanying claims, and all the concept within the equivalent scope of the invention should be construed to be included in the scope of the right of the present invention.

What is claimed is:

1. A magnetic switch, comprising:

an upper frame formed in a box shape and having an open lower surface;

a pair of fixed contacts installed within the upper frame;

a movable contact brought into contact with the pair of fixed contacts to enable conduction of a circuit or separated from the pair of fixed contacts to block conduction of the circuit;

a pair of permanent magnets located on a portion of the upper frame; and a permanent magnet holder coupled to a portion of the upper frame to fix the pair of permanent magnets to the upper frame, wherein a first mounting portion is provided at an outer side of a front surface of the upper frame and a second mounting portion is provided at an outer side of a rear surface of the upper frame in order to place one of the pair of permanent magnets into the first mounting portion and the other of the pair of permanent magnets into the second mounting portion, wherein the permanent magnet holder is formed in a U-shape and coupled to an upper portion of the upper frame to fix the pair of permanent magnets to the upper frame, wherein a holder insertion portion into which the permanent magnet holder is fixed is formed on an upper surface of the upper frame.

2. The magnetic switch of claim 1, wherein the first mounting portion and the second mounting portion each have a groove formed with a width and area to accommodate the corresponding permanent magnet.

3. The magnetic switch of claim 1, wherein the holder insertion portion comprises a groove portion formed between a pair of protrusion portions that protrude in an "11" shape.

4. The magnetic switch of claim 1, wherein a portion of the holder insertion portion protrudes from a front surface of the upper frame to form a support portion.

5. The magnetic switch of claim 1, wherein the permanent magnet holder comprises a body portion formed to transverse an upper surface of the upper frame and bridge portions that extend in a vertically downward direction at both end portions of the body portion.

6. The magnetic switch of claim 1, further comprising bent engagement portions formed at both end portions of the permanent magnet holder to engage lower end portions of the first mounting portion and the second mounting portion.

7. The magnetic switch of claim 1, further comprising adhesion portions formed at both end portions of the permanent magnet holder in order to apply a contact pressure to the pair of permanent magnets.

8. The magnetic switch of claim 1, further comprising a handle portion provided on a portion of the permanent magnet holder.

* * * * *